US012752182B2

(12) United States Patent
Barahona

(10) Patent No.: US 12,752,182 B2
(45) Date of Patent: Oct. 6, 2026

(54) FOOTBALL/SOCCER ACTION BOARD GAME

(71) Applicant: Edwin Barahona, Indio, CA (US)

(72) Inventor: Edwin Barahona, Indio, CA (US)

( * ) Notice: Subject to any disclaimer, the term of this patent is extended or adjusted under 35 U.S.C. 154(b) by 188 days.

(21) Appl. No.: 18/778,971

(22) Filed: Jul. 20, 2024

(65) Prior Publication Data

US 2025/0032896 A1 Jan. 30, 2025

Related U.S. Application Data

(63) Continuation-in-part of application No. 17/697,182, filed on Mar. 17, 2022, now Pat. No. 12,064,701.

(51) Int. Cl.
*A63F 7/06* (2006.01)
*A63F 7/24* (2006.01)
*A63F 7/30* (2006.01)

(52) U.S. Cl.
CPC ..... *A63F 7/0616* (2013.01); *A63F 7/0684* (2013.01); *A63F 7/2481* (2013.01); *A63F 7/30* (2013.01)

(58) Field of Classification Search
CPC ..... A63F 7/0616; A63F 7/2481; A63F 7/30; A63F 7/0684; A63F 7/00; A63F 7/0005; A63F 7/06; A63F 7/0688; A63F 7/0692; A63F 7/07; A63F 7/0017
USPC ..... 273/108–129 W
See application file for complete search history.

(56) References Cited

U.S. PATENT DOCUMENTS 1,536,513 A * 5/1925 Mcnall ..... A63F 7/0684 273/317.7
1,793,969 A * 2/1931 Simmons ..... A63F 7/0608 273/317.9
2,037,416 A * 4/1936 Hull ..... A63F 7/249 273/317.3
2,184,868 A * 12/1939 Williams ..... A63F 7/3065 273/118 A
2,229,232 A * 1/1941 Widegren ..... A63F 7/0684 273/108.51
2,506,190 A * 5/1950 Barnes ..... A63F 7/2472 124/79
2,596,557 A * 5/1952 Huber ..... A63F 7/06 273/129 R
2,760,303 A * 8/1956 Del Mas ..... A63H 3/16 40/418

(Continued)

OTHER PUBLICATIONS

Original and translation of Document ID JP-2006204880-A, titled "Goalkeeper Set", with an inventor named Chin Kwok-Tung Gordon, pp. 1-16, published Aug. 10, 2006. (Year: 2006).*

(Continued)

*Primary Examiner* — Sebastiano Passaniti
(74) *Attorney, Agent, or Firm* — Abraham Seidman

(57) ABSTRACT

A fast-moving soccer/football action game with figures moving on a board; two players face off against each other. Each player controls two action figures plus a goalie. Miniaturized soccer play, just in time for the international soccer championship playoffs. A partial boxed game board is laid out in professional soccer markings. Each of the action figures can "kick" a ball by hand-activated spring-action of the figures. A goalie figure can be stationary of move to block shot on goal. A miniature ball or marble or a more flattened ball-object is used.

1 Claim, 14 Drawing Sheets

(56) References Cited

U.S. PATENT DOCUMENTS 3,554,547 A * 1/1971 Vedeen ..... A63F 7/0684 273/108.51
3,672,674 A * 6/1972 Reed ..... A63F 7/068 273/443
3,699,703 A * 10/1972 Biecker ..... A63J 19/00 446/330
3,806,119 A * 4/1974 Mosciatti ..... A63F 7/0684 273/108.56
3,888,485 A * 6/1975 Conti ..... A63F 7/2472 273/317.5
3,912,269 A * 10/1975 Barlow ..... A63F 7/0684 273/108.56
4,007,932 A * 2/1977 LeBrun ..... A63F 7/0684 273/108.51
4,033,584 A * 7/1977 Smith ..... A63F 7/0684 273/108.55
4,042,239 A * 8/1977 Cecchetti ..... A63F 7/0684 273/108.52
4,146,224 A * 3/1979 Deutsch ..... A63F 7/0684 273/108.52
5,074,557 A * 12/1991 Broussard, Sr. ..... A63F 7/0684 273/237
5,213,325 A * 5/1993 Malavazos ..... A63F 7/386 273/109
5,433,443 A * 7/1995 Ples ..... A63F 7/0684 273/108.56
5,655,767 A * 8/1997 Francis ..... A63F 7/0684 446/330
5,836,803 A * 11/1998 Hamlin ..... A63H 3/46 446/379
5,853,172 A 12/1998 Yetgin
6,659,457 B1 12/2003 Cheng
6,682,071 B1 * 1/2004 Carsten ..... A63F 7/249 273/108.53
6,749,196 B2 6/2004 Sirlachius
6,837,769 B1 * 1/2005 Skov ..... A63H 13/10 446/379
7,140,945 B2 * 11/2006 Dinhofer ..... A63H 13/16 446/309
10,179,276 B2 1/2019 Vaughn
10,688,381 B2 6/2020 Shinado et al.
12,064,701 B2 * 8/2024 Barahona ..... A63F 7/30
2002/0125633 A1 * 9/2002 Mashkabov ..... A63F 7/0684 273/108.53
2002/0164921 A1 * 11/2002 Wilkinson ..... A63H 11/06 446/308
2007/0093174 A1 * 4/2007 Cheung ..... A63F 7/0017 446/336
2007/0117494 A1 * 5/2007 Sheller ..... A63H 13/18 446/309
2017/0282054 A1 * 10/2017 Barahona ..... A63F 7/0616

OTHER PUBLICATIONS

Original and translation of Document ID KR-101861961-B1, titled "Play and games using swing seat", with an inventor named Jeoung Tae Yeun, pp. 1-10, published May 28, 2018. (Year: 2018).*

* cited by examiner

Replacement Sheet

FOOTBALL/SOCCER ACTION BOARD GAME

This application is a continuation in part of application Ser. No. 17/697,182 filed Mar. 17, 2022 (Edwin Barahona).

FIELD

The field of this application is soccer action game boards wherein the game of soccer is imitated in a fashion with the action of the players playing on a game board.

The field is intended to be for low-cost games with a feeling of the individual players having a direct action in playing a soccer-based game.

BACKGROUND

There are a number of soccer machine board games such as Shinado, et al. (U.S. Pat. No. 10,688,381 B2, Jun. 23, 2020) which are somewhat complicated mechanisms requiring more cost to manufacture and while no doubt quite good, are nevertheless limited by cost, in availability to a large, widespread public of children and others who follow the world-wide sport of soccer. Similarly for Yoshihiko, et al. (JP 2015-136427). Again, Cheng (U.S. Pat. No. 6,659,457 B1, Dec. 9, 2003) shows a 'penalty-kick' apparatus, which can be exciting for a youngster, but still involves a more involved apparatus with similar ancillary detriments as listed above, not as a disparagement, but as a cost separator toward more universal availability to youngsters worldwide excited by World Soccer Tournaments.

On another, less complicated approach, Vaughn (10,179,276 B2, Jan. 15, 2019) demonstrates a soccer game with non-movable figures. So, while it captures the lower cost features, it does give up the feature of movable soccer action player figures. This is not a disparagement but just recognizing a limitation. Similarly static soccer board games include Yetgin (U.S. Pat. No. 5,853,172, Dec. 29, 1998).

Sirlachius (U.S. Pat. No. 6,749,196 B2, Jun. 15, 2004) uses a channelized honeycomb with a number of movable game pieces. While this approach allows movable figures to travel on different paths, nevertheless, because a player has only two hands, the total number of figures that can be played simultaneously is limited.

The hexagonal arrangements of paths provide multiple paths but also tends to prevent "fast breaks" in the sense of a breakaway soccer player moving down the field for a goal.

SUMMARY

In one exemplary embodiment of the current invention there is a game surface board resembling the surface of a soccer field, in reduced dimensions, with soccer figures ("dolls") moved in slots on the surface board, where the dolls are attached to short springs which penetrate the surface of the board and are held upright on the board by hardware nuts or washers and nuts. The soccer figure dolls can "kick" the "soccer ball" which may be an ordinary marble or a hemispheric-like partial spherical "soccer ball". It does the "kicking" by a player pulling back slightly on the spring and the spring-mediated return action impinging on the "soccer ball" object and transferring momentum to the "soccer ball" object. The soccer figure dolls have a footlike protuberance which is located when the soccer figure doll is in place on the surface board, slightly off the surface board, allowing the soccer figure doll to have some freedom of movement so as to be bent by a player and let go with the spring potential energy at the extreme point of the player bending back a doll, let go and converting to kinetic energy which impacts the soccer ball object and with the transfer of linear momentum, sends the soccer ball object on its way.

In a second exemplary embodiment of the current invention, which includes the above description of the spring-mounted soccer figure dolls, but which additionally allows for a rotational movement about the vertical axis of the spring. The soccer figure dolls may have a more elongated footlike protuberance. In this embodiment, passing of the soccer ball object by a rotational flipping motion to engage the elongated footlike protuberance, is enabled, along with the spring "pull-back-and-release" action of moving the soccer ball object.

In each of the above exemplary embodiments, each may be further embodied in a "simple" multi-slot configuration; or each may have a surface board with additional "off-shoot" slots.

Advantageously, the simple multi-slot embodiments of 4 main parallel slots, 2 for each player, with one centrally located half slot for each player, allow for a fast action, direct game. The main slots tend to run most of the length of the playing surface, while the central slots tend to run somewhat short of half the distance and could be regarded as a central main slot which has been truncated in half latitudinally.

Advantageously, a multi-slot configuration with off-shoots allows for a more complicated player action, with a soccer figure doll being moveable into an off-shoot, not-very-long subsidiary slot, so as to gain a better playing position, or to retrieve a soccer ball object, to bring it back to the main flow of the game soccer figure movements.

As well as a marble or marble sized plastic ball, a soccer ball object may be in the form of a hemispheric or a hemisphere of an oblate ("squashed") sphere, which has the edges of its bottom beveled so as not to have its motion altered as it slides over the game board surface with its slots. Additionally, the slots may be beveled to aid in this ease of motion, for the oblate hemispheroid soccer ball object.

BRIEF DESCRIPTION OF DRAWINGS

The accompanying drawings, which are incorporated in and constitute a part of this specification exemplify embodiments of the present invention and, together with the description, serve to explain and illustrate principles of the inventive technique. Specifically.

DETAILED DESCRIPTION

In the following detailed description, reference will be made to the accompanying drawing(s), in which identical functional elements are designated by like numerals. The aforementioned accompanying drawings show by illustration, and not by limitation, specific embodiments and implementations that are consistent with the principles of the present invention. These implementations are described in sufficient detail to enable one skilled in the art to practice the invention and it is understood that other implementations may be utilized and that structural changes and/or substitutions of various elements may be made without departing from the scope and spirit of the present invention. The following detailed description is, therefore, not to be construed in a limiting sense.

Figure 1:
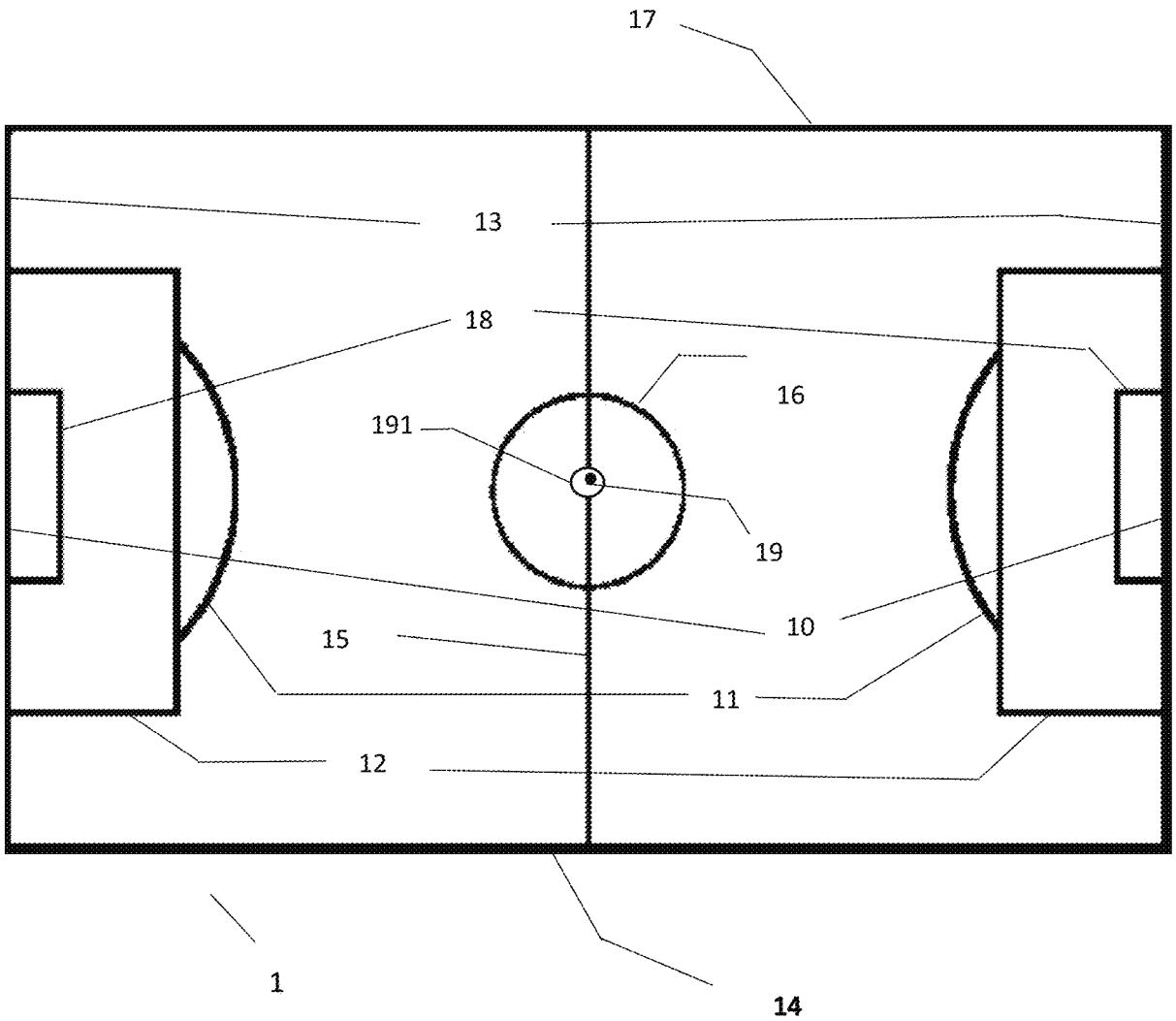
FIG. 1 is a plan view of the game board layout showing analogous soccer field markings.

FIG. 1 is a plan view of the soccer game board's surface 1 where the upper side touchline 17 and the lower side touchline 14 along with the two goal lines 13 form the boundaries of the game board playing field. There are not any out-of-bounds portion of the game board's playing surface. The center point 19 and the center circle 16 are depicted as shown, as are the goal box delineations 18 and the penalty boxes 12, with the penalty shoot arcs 10. A bubble level is shown 191. The surface of the field is green with either white or black lines or a combination of black and white lines. The goals 11 are of a contrasting color such as red or yellow and extend along the goal lines 13, but within the limits set by the goal boxes 18.

Figure 2:
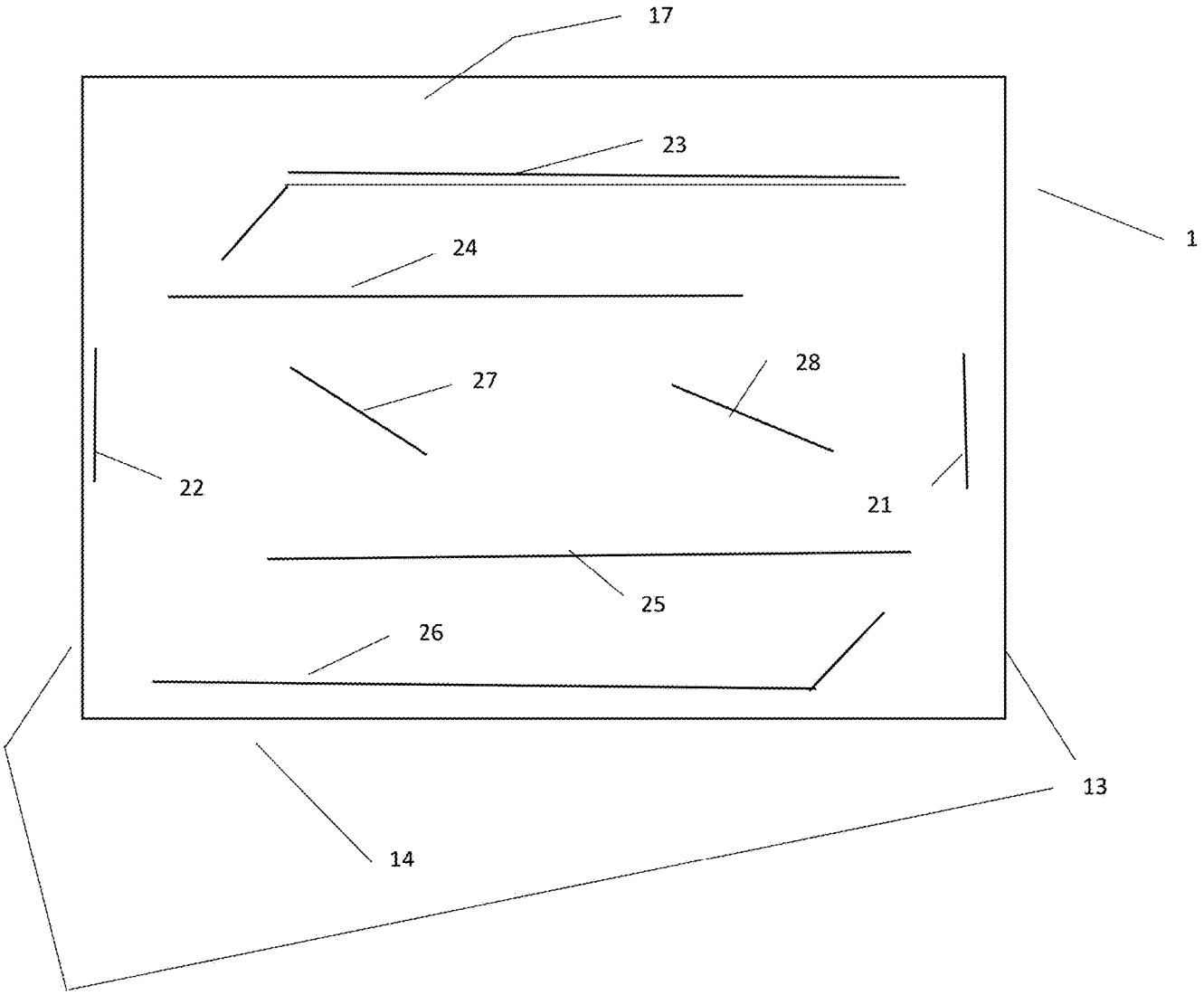
FIG. 2 is a plan view of the game board showing four soccer game doll movement tracks.

FIG. 2 is a plan view of the soccer game board surface 1 with the soccer doll figures movement slots 21, 22, 23, 24 25, 26, 27, and 28. The touch lines 14 and 17, along with the two goal lines 13 delineate the playing surface.

Figure 4A:
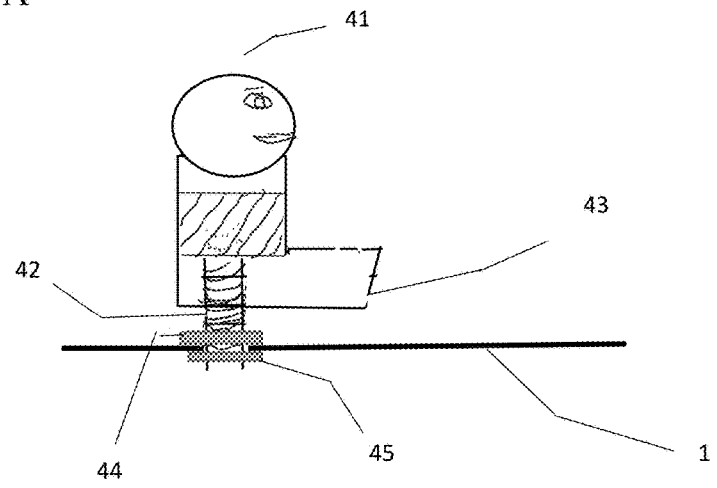
FIG. 4A depicts a soccer game player "doll" which moves along a game movement track and indicates the details of the player "doll", with spring and nut and washer assemblies.
Figure 4A:
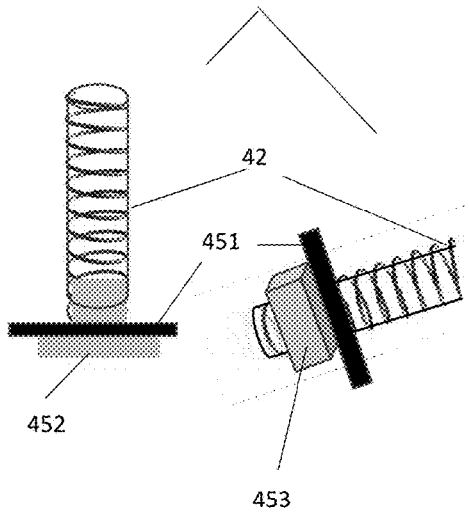
Figure 4A:
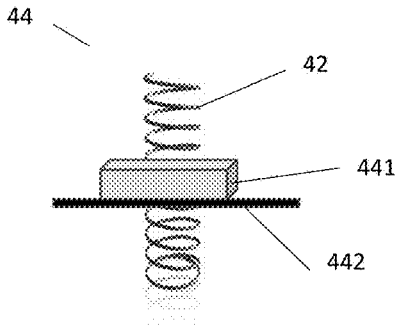

Slots 21 and 22, which will allow for a soccer game player doll (FIG. 4, 41) to move along a slot with its spring stem (FIG. 4A, 42) within a slot. Slots 21 and 22 are for the soccer game player dolls (FIG. 4A, 4I) which are goal tending soccer game player dolls (FIG. 4A, 4I), one for each of two opposing (human) players of the game. Thus, each player controls three (FIG. 4A, 4I). In the case where the goal tending doll (FIG. 4A, 4I is stationary and does not move in a slot 21, 22, each of two players controls two dolls (FIG. 4A, 4I).

Slots 21, 23, 25 and 27 belong to a first player of the game, along with slot 21, each slot having a soccer game player doll (FIG. 4A, 4I), so the first game player has three soccer game player dolls (FIG. 4A, 4I) with which to play.

Slots 22, 24, 26 and 28 belong to a second player of the game, along with slot 22, each slot having a soccer game player doll (FIG. 4A, 4I), so the second game player has three soccer game player dolls (FIG. 4A, 4I) with which to play.

It is remarked here that each set of the three opposing soccer game playing dolls (FIG. 4A, 4I) are distinguished by marking which may be different colors or color patterns, or by stickers representing well-known actual international soccer teams or interchangeable, affixable markings.

The slots 21, 21, 23, 24, 25, 26, 27, and 28 are made wide enough to accommodate the soccer game player doll spring stem (FIG. 4A, 42) so that the soccer player game doll (FIG. 4A, 4I) is freely movable by a first and second game player, using a game player's hand. A game player will move that game player's soccer game player doll (FIG. 4A, 4I) along a slot while pushing a soccer ball object (FIG. 5, 40) and using the bendable spring action (FIG. 5, 42) to impelled the soccer ball object (FIG. 5, 40) toward an opposing goal (FIG. 1, 11).

In this preferred embodiment of the current invention, while the action soccer game is designed to be played fast, there may arise situations where the soccer ball object (FIG. 5, 40) becomes stationary in a place where neither the first nor second game player can activate the soccer ball objects motion, in which case a rule of this version game's embodiment is that the player who has last contacted the soccer game ball object (FIG. 5, 40) allows the opposing player to place the soccer game ball object (FIG. 5, 40) in front of that opposing game player's goal tending soccer player doll (FIG. 5, 41), located at slot 21 or 22, so that the opposing goal tending soccer player's goal tending soccer player doll (FIG. 4A, 4I), located at slot 21 or 22, is able to contact the soccer game ball object (FIG. 5, 40) and impel it into play. In another preferred embodiment, the goal tending dolls (FIG. 4A, 4I) are stationary, and slots 21 and 22 are not present.

Figure 3:
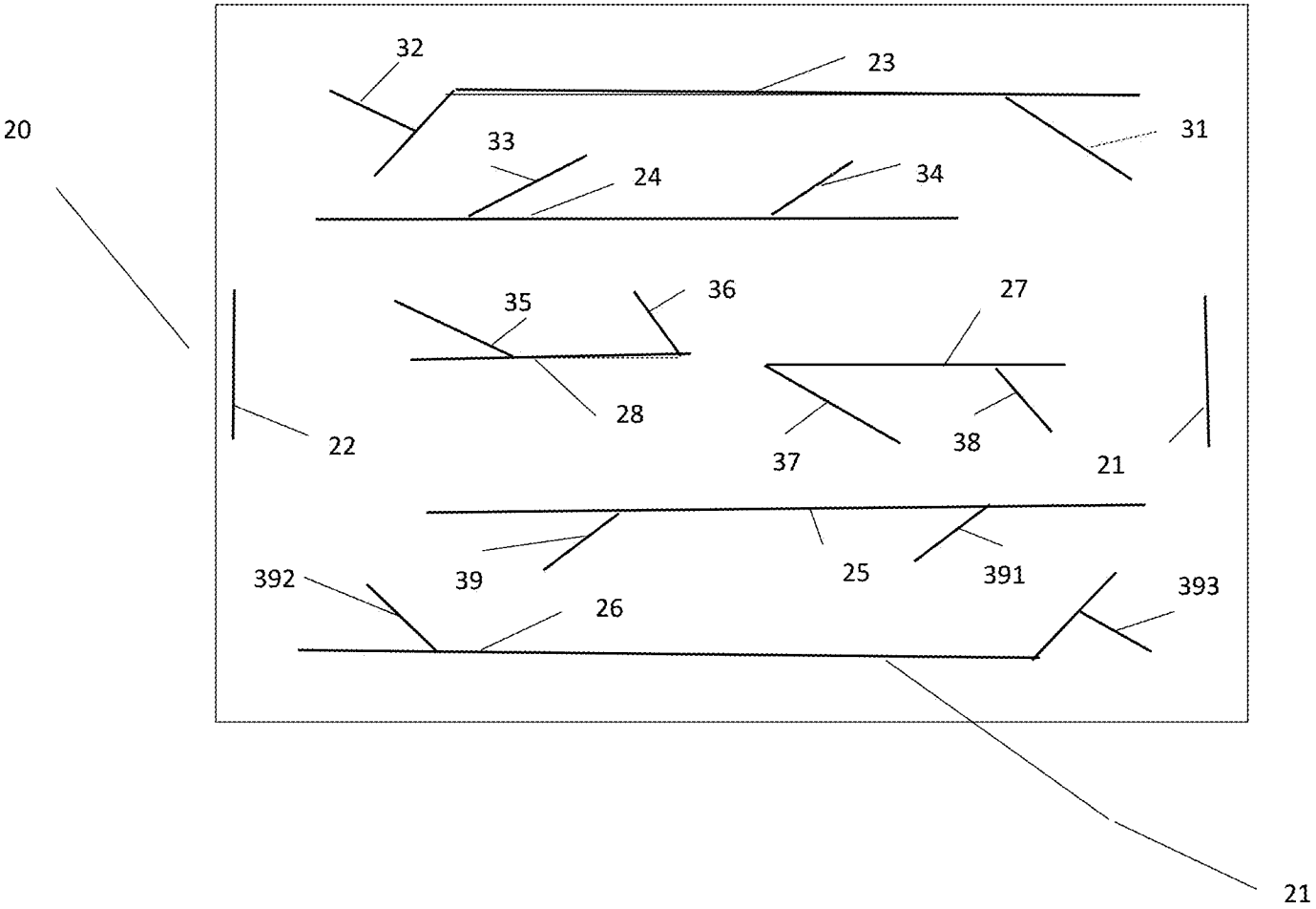
FIG. 3 is a plan view of the game board showing a greater number of game movement tracks.

FIG. 3 is a plan view 20 of another embodiment of the current invention. It shows the additional slots which allow (1) for more of the soccer action board game's playing field to be reached by a first game player's soccer game player dolls (FIG. 4A, 4I) and by a second player's soccer game player dolls (FIG. 4A, 4I); and (2), allows for a wider variety of soccer action game attack and defend options, for a first and a second player. The number of soccer game player dolls (FIG. 4A, 4I) remains at three for each of the players.

The additional slots shown in FIG. 3 are 31 and 32, on the previously shown slot 23, which is here present; and further, slots 33 and 34, on the previously shown slot 24, which is here present; and slots 35 and 36, on the previously shown slot 28, which is here present; and slots 37 and 38, on the previously shown slot 27, which is here present.

Further, additional slots shown are lots depicted are slots 39 and 391 on the previously shown slot, 25, which is here present. Also, additional slots depicted are 392 and 393 on previously shown slot 26, which is here and present.

Figure 5:
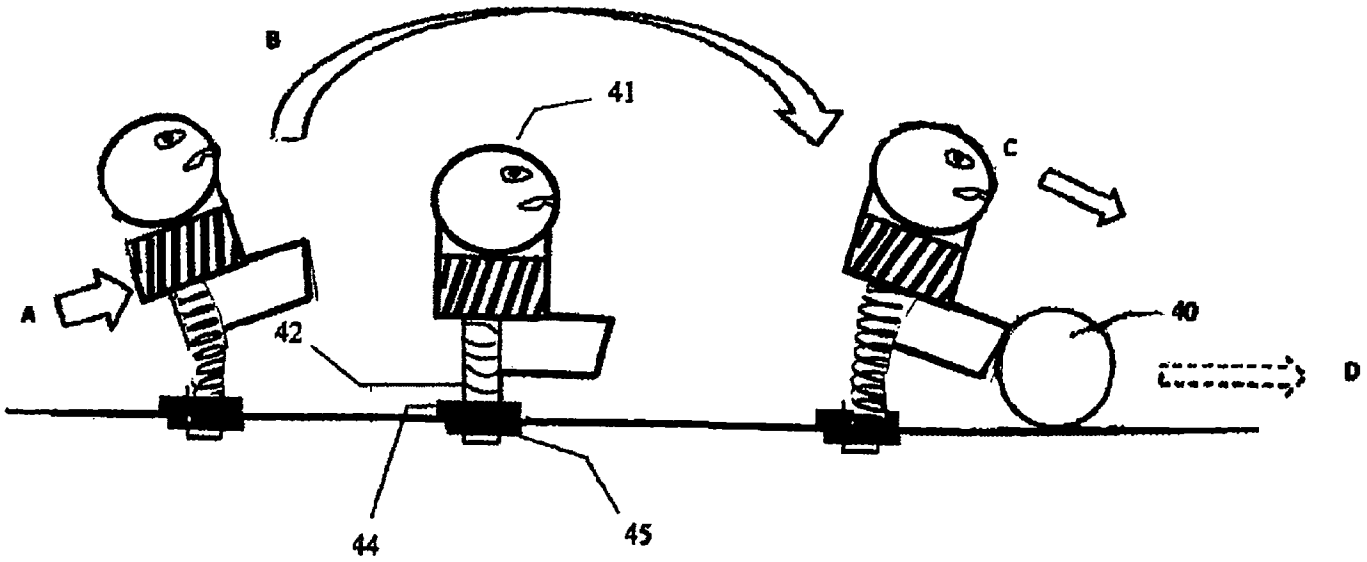
FIG. 5 demonstrates the "kicking" sequence when using a soccer game player "doll" to impart momentum to the soccer game ball object or oblate hemispheric soccer game ball object alternative.

FIG. 4A shows an exemplar of the soccer game player doll 41. The body of the soccer game player doll includes a protrusion "kicking" foot 43 which serves in contacting a game ball object (FIG. 5,40). The spring 42 is held in place on a playing surface (FIG. 1,1) in one of the slots (FIG. 2; 21, 22, 23, 24, 25, 26, 27, 28); or in one of the slot extensions in another.

embodiment with slot extensions (FIG. 3; 31, 32, 33, 34, 35, 36 37, 38, 39, 391, 392, 393) by an upper 44 attachment assembly and a lower 45 attachment assembly.

The lower attachment assembly 45 may include a bolt 452, which threads part-way into the spring through the open bottom of the spring 42, and a lower assembly washer 451, or, a nut 453 threaded externally on the spring 42 with a lower assembly washer 451. Alternatively, the lower assembly washer 451 may be welded to the spring 42.

The upper attachment assembly 44 may have a nut 441 threaded on the spring with an upper assembly washer 442. Alternatively, the upper assembly washer may be welded to the spring 42, or attached by known methods in the art, such as an epoxy.

In a first preferred embodiment the upper assembly washer 442 and lower assembly washer 451 have a diameter of one inch, although the diameter may vary as long as the doll 41 is able to be supported well enough that the spring 42 does not wobble.

Figure 4B:
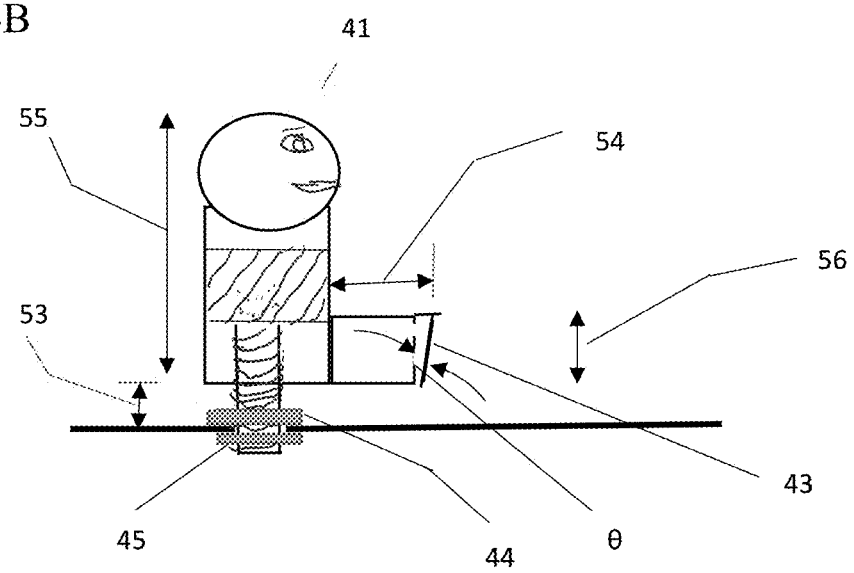
FIG. 4B indicates some typical dimensions for the doll, in one preferred embodiment.

FIG. 4B indicates some typical dimensions for the doll 41. In one preferred embodiment the height 55 of the doll 41 is 2 inches, although the height 55 may range from 1 inch to 3 inches. The spring clearance 53 is in one preferred embodiment 0.5 inches. The protruding foot 43 length 54 at its top in one preferred embodiment is 0.25 inch. The height 56 of the protruding foot is 0.75 inches in one preferred embodiment. The angle θ of the front face of the protruding foot 43 is 10 degrees forward in one preferred embodiment. Other preferred embodiments may range from 10 degrees backward to 15 degrees forward.

FIG. 5 shows an animation of using the doll 41 and the attached spring 42 which are mounted in a slot 27 such as shown in FIG. 2. Here the playing surface 17 is shown in profile, and a perspective of slot 27 is not shown. A player pulls back on that player's doll, bending the spring back (position "A"). As the player releases the doll, the spring tends to return the doll to an upright position (position "B"). The doll overshoots a bit (position "C") and imparts a velocity (schematically shown as arrow "D") to the soccer ball object 40.

The spring 42 is approximately a Hooke's law object with a bending spring constant k, such that as the angle of the spring 42 being bent back (position "A"), the spring 42 becomes capable of a force proportional to the angle of bend times the Hooke's law constant k. This force, F, proportional to $kd\theta$ where $d\theta$ is the bend angle, acts on the soccer ball object 40 as it contacts the soccer ball object 40 over a time $\Delta t$ (noting positions "B" and "C"), and the momentum MV imparted is $F\ \Delta t$. M is the mass of the soccer ball object 40. Consequently, the velocity V imparted to the soccer ball object 40 is then $V=F\ \Delta t/M$. Thus $V=k\ d\theta\ \Delta t/M$ and the soccer ball object 40 is propelled toward the opposing goal.

Figure 6:
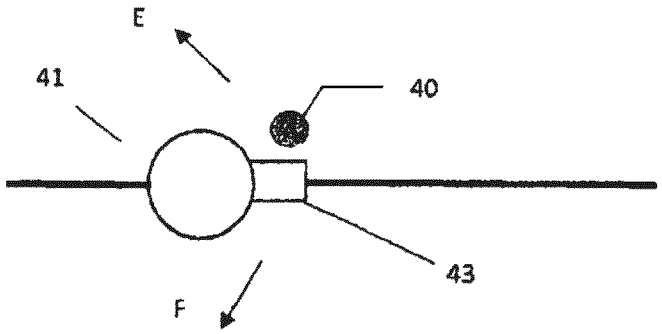
FIG. 6 shows the rotational capability of a player "doll" to impart momentum to the soccer game ball objector soccer game ball object alternative in order to move the game ball object/object alternative toward opposing goal or to position the game ball object/object alternative prior to attempting a goal shot.

FIG. 6 illustrates the operation (by a player) of the doll 41 in rotational motion toward "E" or "F". The doll's 41 protruding foot 43 engages with the soccer ball object 40 to move the ball toward the goal line (FIG. 1, 13) of the opposing player, or to pass the soccer ball object 40 to another doll 41 of the player. Further, the sliding motion of the doll 41 along a slot (e.g., FIG. 2, 27) is indicated by forward "G" and back "H" directions.

Figure 7:
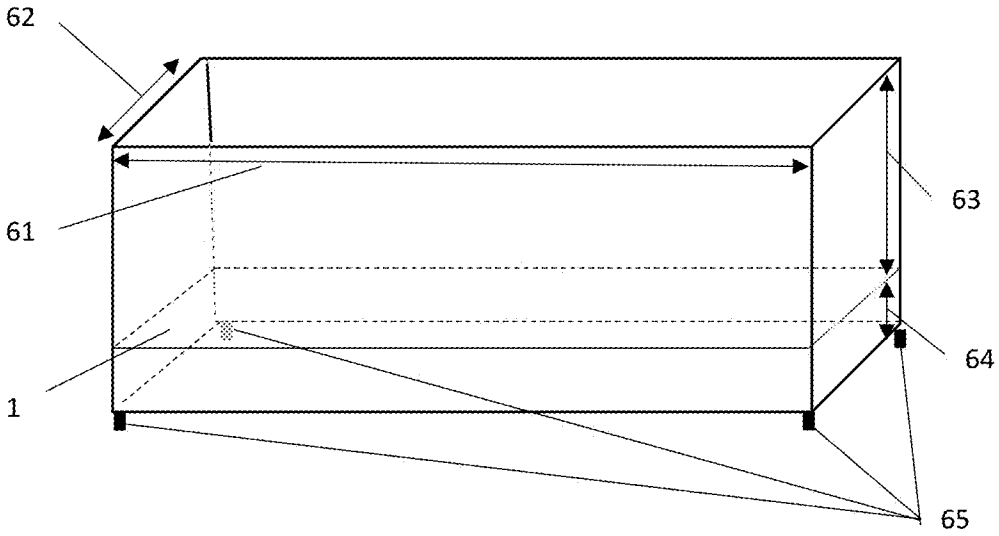
FIG. 7 shows a three-dimensional sketch of the overall layout and construction of the football/soccer action game assembly, showing a box with an open top, but with side extending upward, on all sides, so as to retain a soccer game ball object within the game assembly.

FIG. 7 depicts a "three-dimensional" presentation of the football/soccer action game construction. There are screw height adjusters 65 on the four bottom corners of the soccer action game construction. These operate in conjunction with a bubble level (not shown) imbedded in the soccer game playing surface 1.

The soccer game playing surface typically 0.25 inch thick, depending upon the material. It may consist of wood, plastic, metal, or composite. Grooves, such as shown in FIGS. 2 and 3, are cut through its surface.

The elongated sides 61 are typically 16-24 inches long. The narrower sides 62 are 10-16 inches. The heights 63 of all sides above the playing surface 1 is 2-2.5 inches and the height 64 below the playing surface 1 is typically 0.25 inch. A typical thickness (not shown) is typically 0.25 inch, and depends on the choice of the construction material, as noted above, for the playing surface 1 (wood, etc.).

A first preferred embodiment wood has playing surface 1 of 0.25 inch-thick wood and elongated sides 63 of 0.375 inch thick wood and 24 inches length. The narrower sides would have 0.25-inch-thick wood.

The exact dimensions are not critical.

Figure 8:
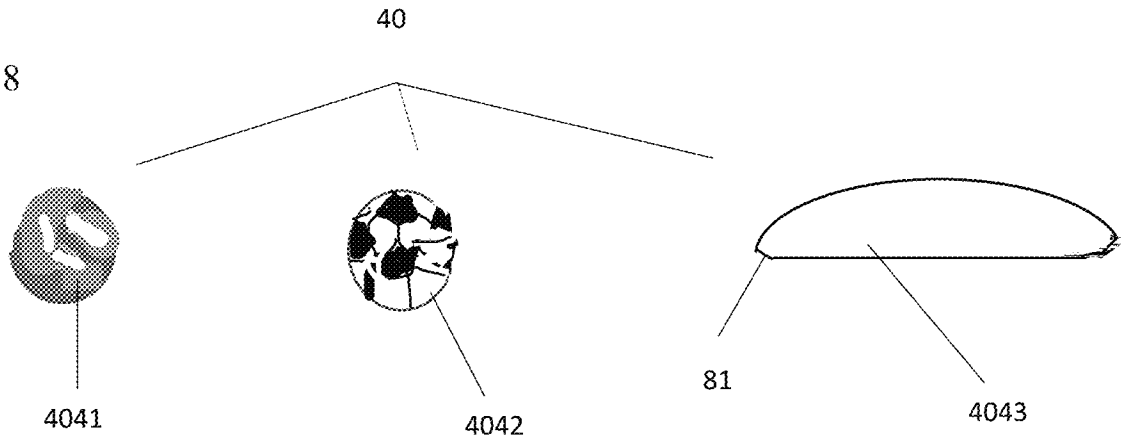
FIG. 8 illustrates three versions of the soccer ball object.

FIG. 8 shows three versions of the soccer ball object 40. The first version is a common glass marble 4041. The second version is a plastic ball 4042 with standard soccer ball markings. This plastic ball 4042, in one preferred embodiment, is approximately the size of the glass marble. The dimensions are not critical. The weight is in the range of half that of the glass marble. The third version 4043 of the soccer ball object is a hemispheric part of an oblate spheroid. The material is typically plastic although other materials such as wood may be utilized. The bottom edge 81 of the hemispheric oblate spheroid is beveled to counter any tendency to be channeled by a slot (e.g., FIG. 2, 27). The diameter of the hemispheric oblate spheroid 4043 is typically in the range of that of a common glass marble to 3 times the diameter of the glass marble, with one preferred embodiment with a diameter of twice that of a common glass marble.

Figure 9:
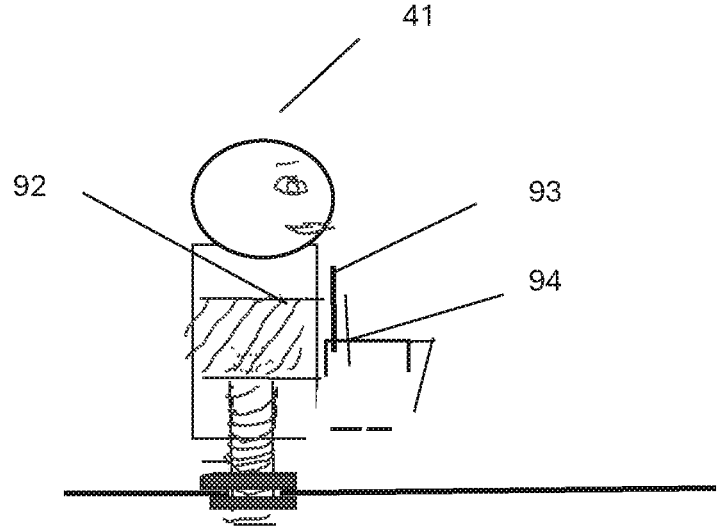
FIG. 9 illustrates the attachable color ensembles which distinguish the doll's of each player's side.

FIG. 9 shows that each of the dolls 41 on one player's side have a color ensemble 92, 93 such that the dolls 41 of each side have a different color ensemble 92, 93 so that each player's side is distinguished.

A player's side's color ensemble may be printed on stick-on stickers 92 which may be stuck on each of the dolls on one player's side while the dolls of each side have a different color ensemble so that each player's side is distinguished. The color ensemble may be printed on paper cards 93 which are placed in a slot 94 on each doll of each player. The paper card 93 is shown in FIG. 9 in side view, and the slot 94 would extend around each doll 41. In an exemplary preferred mode, it can be made of a transparent plastic.

Figure 10:
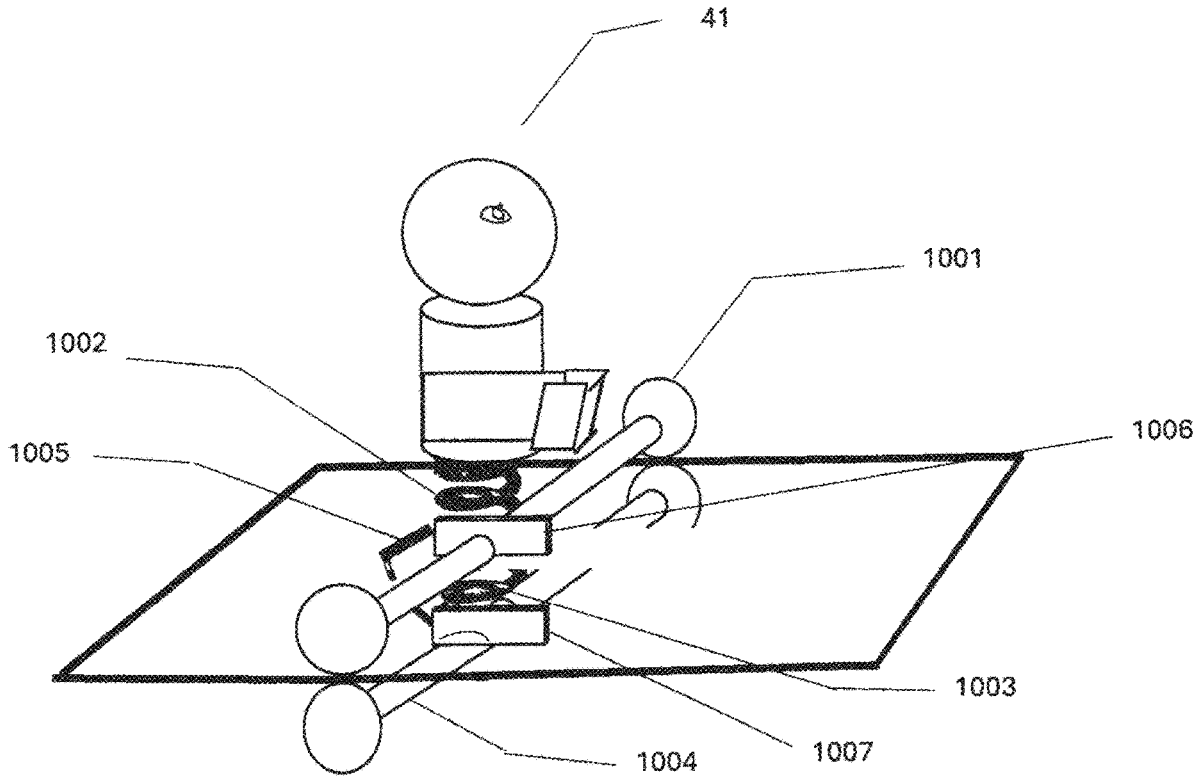
FIG. 10 shows an alternative mode of attachment to the surface of the game board, using small wheels on axles.

FIG. 10 shows that a doll may be attached to the game board by a spring-loaded 1003 pair of axles 1004 with small wheels 1001 at each end. The upper spring 1002 is the spring which is the spring which is bent back (by hand) on the doll 41 and released to propel a soccer ball object. The upper spring attached between the doll 41 and an upper attachment block 1006 A second spring 1003 extends between the upper attachment block 1006 and a lower attachment block 1007. This second spring 1003 spring loads the axles 1004 and the wheels 1001 (note: for clarity only one of each is called out). The upper axles (e.g., 1004) and wheels (e.g., 1001) are compressed toward the lower axles (e.g., 1004) wheels providing a holding force on the game-board surface 1. A stabilizing device 1005 is shown in more detail in FIG. 11. The lower spring 1003 and the stabilizing device 1005 penetrate through a generic slot 1008 in the game-board surface. A first preferred embodiment has wheels (e.g., 1001) of diameter 0.28 inch and axles (e.g., 1004) of 0.125 inch. A first preferred embodiment has the wheel-axle-axle-wheel combination spanning a distance of one inch.

Figure 11:
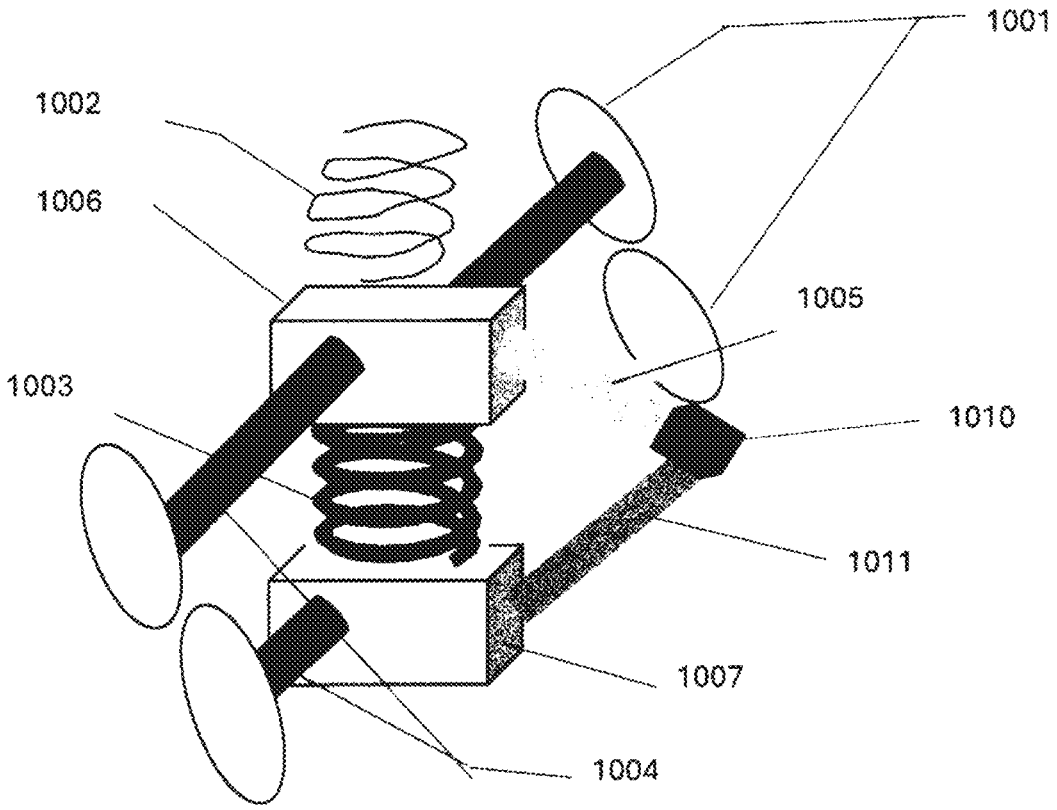
FIG. 11 depicts some details of the wheeled alternative mode of attachment to the game-board surface.

FIG. 11 shows details of the lower part of FIG. 10. Again, the upper spring 1002 attaches to the doll 41 and extends down to a first attachment block 1006. This is the spring 1002 attached between which is bent by the doll 41 (using fingers) to propel the soccer-ball object. The lower spring

1003 attaches between the upper block 1006 and the lower block 1007 and pulls the lower block 1007 towards the upper block 1006, acting to clamp the upper wheels (e.g., 1001) and axles (e.g., 1004) and the lower axles (e.g., 1004) and wheels (e.g., 1001) to the game board surface. The lower spring 1003 extends through game board surface 1 and thus in a first preferred embodiment is a minimum of 0.25 inch in length.

The stabilizing device has an upper arm 1005 which connects to a lower arm 1011 by way of a hinge 1010 and extends through a generic slot. When the upper spring 1002 is bent with some sidewise component, the stabilizer device (comprising upper an arm 1005, a lower arm 1011 and a hinge 1010) moves only a little toward a side of a generic slot and acts to stabilize the whole doll 41 and wheeled base assembly. In a first preferred embodiment, a stabilizing device has an upper arm 1005 of 0.175 inch in diameter or square cross-section and the same for the lower arm 1011. An upper anchoring block 1006 and a lower anchoring block 1007 act to support right and left axles (relative to the dolls facing direction, when at rest) and provide attachment point for the upper spring 1002 and the lower spring 1003.

Figure 12:
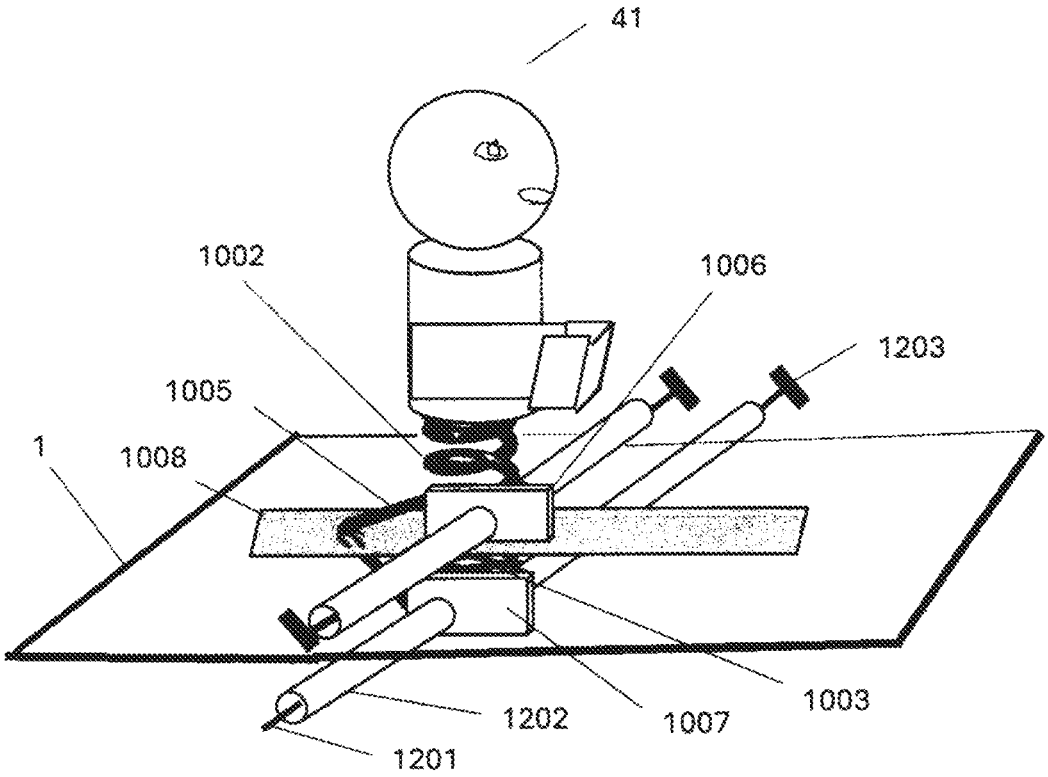
FIG. 12 shows a second alternative mode of attachment using thin cylinders or tubes.

FIG. 12 reprises FIG. 10, however, with thin cylinders 1202 on axles 1201 instead of wheels on axles. The purpose is to provide more contact surface with the top of the game board 1 As in the previous FIG. 10 there is an upper spring 1002 and a lower spring 1003 as well as an upper anchoring block 1006 and a lower anchoring block 1007. Here there are cylinders (e.g., 1202) on axles (e.g., 1201). The lower spring 1003 extends through a generic slot 1008.

Figure 13:
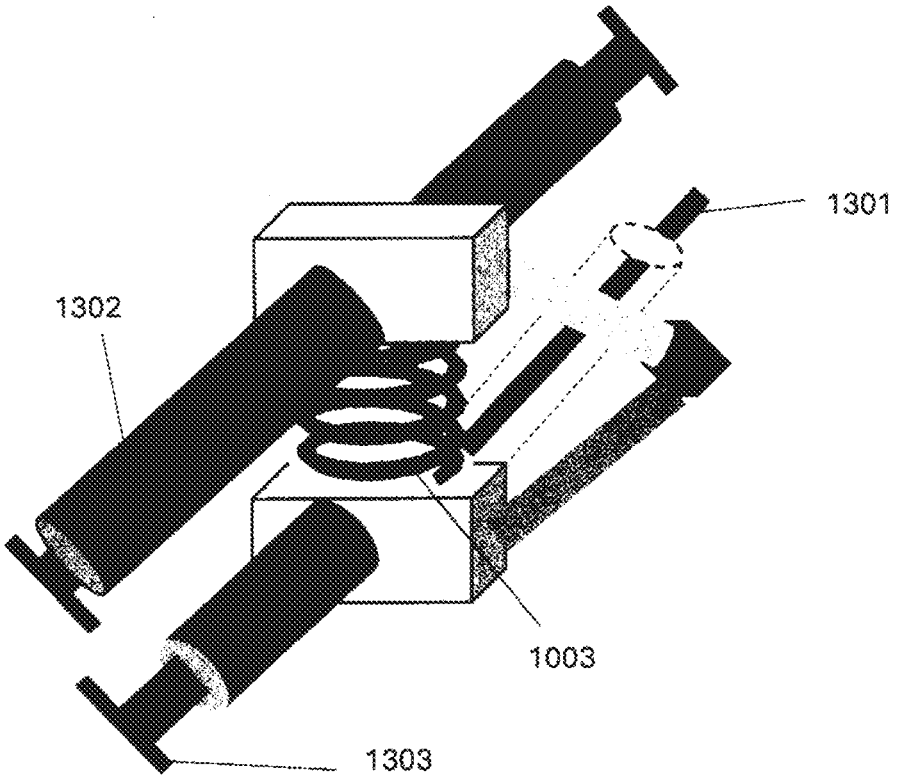
FIG. 13 illustrates details of the second alternative mode of attachment using thin cylinders/tubes on axles.

FIG. 13 reprises FIG. 11, however, with thin, elongated cylinders 1302, on axles 1301. The cylinders (e.g., 1302) are held on the axles (e.g., 1301) by an end cap (e.g., 1303). A first preferred embodiment has cylinders 1302 of outside diameter 0.172 inch and an individual length of 0.5 inch, with axles of 0.125-inch diameter.

It is intended that the specification and examples are exemplary only, with a true scope and spirit of the invention being indicated by the appended claims.

The invention claimed is:

1. A soccer action board game, comprising:

a playing surface comprising a first material for supporting the playing surface and including visible markings, wherein the visible markings include an upper side touchline, a lower side touchline and two goal lines, all of which together form a boundary of a playing field of the playing surface;

wherein one side of the board game adjacent one of the two goal lines defines a first playing side and another side of the board game adjacent the other one of the two goal lines defines a second playing side;

a simulated miniature soccer goal plastic net located on the playing surface adjacent each of the first playing side and the second playing side and adjacent each of the two goal lines;

a simulated soccer ball;

a plurality of slots cut through the playing surface and configured to enable a plurality of soccer action figure dolls to be held within the slots and movable along the slots;

the plurality of soccer action figure dolls comprising three soccer action figure dolls configured to be controlled by a hand of a first player from the first playing side and further comprising three additional soccer action figure dolls configured to be controlled by a hand of a second player from the second playing side;

each one of the plurality of soccer action figure dolls comprising a body portion, an elongated protruding foot portion and an imbedded spring extending downward from the body portion and located substantially above the playing surface when the dolls are oriented in a substantially vertical position with respect to a generally horizontal and planar orientation of the board game;

wherein the imbedded spring is anchored by an upper assembly situated on the playing surface and by a lower assembly pressing on the first material supporting the playing surface from below;

the upper assembly comprising a first block attached to the imbedded spring and a set of two axles perpendicular to the direction defined by the elongated protruding foot portion of the soccer action figure doll wherein each axle extends on each perpendicular side wherein each axle ends with an attached wheel and wherein each wheel is free to rotate, and a second spring upper assembly extends down from the first block toward a second block;

and the lower assembly comprising the second block which is attached to the second spring wherein the second spring acts to pull the lower assembly and the defined by the elongated protruding foot portion of the soccer action figure doll wherein each axle extends on each perpendicular side wherein each axle ends with an attached wheel and wherein each wheel is free to rotate;

a stabilizing device comprising a downward arm extending downward at approximately a 45 degree angle in line with a slot the doll is associated with wherein the downward arm is attached to the first block in the upper assembly and wherein the downward arm is attached to an upward arm by a hinge wherein the upward arm is attached to the second block in the lower assembly and wherein the upward arm extends upward at approximately a 45 degree angle;

the upper assembly attached to the imbedded spring; wherein the arrangement of the imbedded spring combined with the upper assembly and the lower assembly is configured to enable the protruding foot portion to remain slightly elevated above the playing surface when the soccer action figure dolls are not engaged by a hand of a player;

wherein the imbedded spring is configured to enable each one of the soccer action figure dolls to bend in a backward direction so as to further raise the protruding foot portion above the playing surface or to rotate about a vertical axis passing through the imbedded spring by using the hand of the player, and wherein releasing the soccer action figure dolls by the hand of the player allows the elongated protruding foot portion of each one of the soccer action figure dolls to either pass a simulated soccer ball to another one of the plurality of soccer action figure dolls or to directly impel the simulated soccer ball into the plastic net of the opposing playing side;

wherein the stabilizing device downward and upward arms are disposed to be in the slot and provide stabilization; wherein, when the first spring is bent in a direction not in a direction of a length of the slot associated with the doll, the downward and upward arms of the stabilizing device press against the side of the slot to provide stabilization of the doll;

a structure comprising four upright sides forming a box open on a top side and on a bottom side; wherein the first material of the playing surface attaches to the box;

a plurality of adjustable screw levelers, wherein one screw leveler of the plurality of screw levelers is disposed at a bottom of each corner of the box, wherein a total of four screw levelers is attached to the bottom corners of the board game;

a bubble level, wherein the bubble level is embedded into the playing surface of the soccer action board game; and each one of the plurality of soccer action figure dolls associated with the first playing side having a color ensemble that is different from a color ensemble of the soccer action figure dolls associated with the second playing side.

* * * * *